US005375648A

United States Patent [19]

Idogawa et al.

[11] Patent Number: 5,375,648

[45] Date of Patent: Dec. 27, 1994

[54] APPARATUS AND METHOD FOR CONTINUOUS CASTING OF STEEL

[75] Inventors: Akira Idogawa; Nagayasu Bessho; Kenichi Sorimachi; Tetsuya Fujii; Toshikazu Sakuraya, all of Chiba, Japan

[73] Assignee: Kawasaki Steel Corporation, Japan

[21] Appl. No.: 116,138

[22] Filed: Sep. 2, 1993

[30] Foreign Application Priority Data

| | | | |
|---|---|---|---|
| Sep. 4, 1992 | [JP] | Japan | 4-236643 |
| Mar. 29, 1993 | [JP] | Japan | 5-069982 |
| Jun. 17, 1993 | [JP] | Japan | 5-146466 |

[51] Int. Cl.[5] ..... B22D 27/02

[52] U.S. Cl. ..... 164/471; 164/507

[58] Field of Search ..... 164/471, 507

[56] References Cited

U.S. PATENT DOCUMENTS

| | | | |
|---|---|---|---|
| 4,465,118 | 8/1984 | Dantzig et al. | 164/467 |

FOREIGN PATENT DOCUMENTS

| | | | |
|---|---|---|---|
| 53-45292 | 12/1978 | Japan | 164/471 |
| 60-49834 | 3/1985 | Japan | 164/504 |
| 4-17949 | 1/1992 | Japan | 164/507 |

*Primary Examiner*—Kuang Y. Lin

*Attorney, Agent, or Firm*—Austin R. Miller

[57] ABSTRACT

An apparatus and method for continuous casting steel. A vertical continuous-casting mold consists of a pair of long side frames and a pair of short side frames formed of a metal having low electrical conductivity. An immersion nozzle supplies molten steel to the mold. An induction heating coil surrounded by a backup frame surrounds the vertical continuous-casting mold. The induction heating coil induction-heats the surface of the molten steel and neighboring portions thereof. The apparatus meets the following conditions;

$$\xi^2=\sigma_1/\sigma\leqq 4$$

$$1/10\leqq\eta=(2\mu_0\cdot\sigma_2\cdot\omega)^{0.5}\cdot d\leqq 10$$

where $\xi$ designates the ratio of electrical conductivity of the mold and the molten steel $\sigma_1$ designates the electrical conductivity of the mold $\sigma_2$ designates the electrical conductivity of the molten steel $\mu_0$ designates the permeability in a vacuum d designates the thickness of the mold $\omega$ designates the pulsatance of the electromagnetic wave $\eta$ designates the ratio of the penetration depth of the magnetic field to the molten steel to the mold thickness.

7 Claims, 9 Drawing Sheets

APPARATUS AND METHOD FOR CONTINUOUS CASTING OF STEEL

BACKGROUND OF THE INVENTION

1. Field of the Invention

The present invention relates to an apparatus and method for continuous casting of steel including the step of induction-heating a molten steel surface in a mold and producing cast products having improved surface characteristics.

2. Description of the Related Art

In general, the surface characteristics of cast products obtained by continuous casting of steel are strongly dependent upon the condition and manner in which molten steel begins to solidify in the mold, that is, the conditions of the initial solidification.

The conditions of initial solidification are determined by a variety of factors such as (1) vibration (if any) of the mold; (2) friction (lubrication) of the mold and the cast products; (3) loss or escape of heat conditions in the vicinity of the meniscus on the molten steel surface; (4) flow characteristics of the molten steel in the mold, and others.

The initial solidification conditions are actually determined by many factors that influence each other in a complicated manner. Above all, it is believed to be important to provide and achieve special control of the thermal conditions existing at the meniscus in order to obtain cast products having good surface characteristics.

In order to vary the applicable thermal conditions, various methods are available such as varying the rate of heat escape by using various mold materials, and by heating the meniscus from outside the mold.

As disclosed in Japanese Patent Publication No. 57-21408, in a conventional mold used for continuous casting, an induction heating coil is arranged at the rear of a coiling plate of a mold made of copper. Since copper has high electrical conductivity, it is necessary in order to effectively heat the molten steel either to provide a low frequency to the induction heating coil, or, if a high frequency is applied, the thickness of the copper plate must be reduced as much as possible to approximately 1 mm, for example.

However, if low frequency is applied in such a case, the molten steel in the mold is stirred so as to become contaminated with mold powder, impairing the quality of the product.

If the thickness of the copper plate is further reduced, the copper plate is vulnerable to damage by heating, with the serious result that when the molten steel is brought into contact with cooling water in the mold, a steam explosion is likely to occur.

Variation of thermal conditions can be achieved by changing the mold material, including the use of a Ni—Cr—Fe alloy having low heat conductivity and high strength at a high temperature, as disclosed in Japanese Patent Laid-Open No. 3-264143.

However, a serious drawback of this approach is that the thermal conditions at the meniscus cannot then be controlled with precision or accuracy. For example, the thermal conditions at the meniscus are at least partially dependent upon the casting conditions, such as the casting speed and the temperature of the molten steel introduced into the mold, causing ineffective results similar to those produced when conventional copper molds are used.

Another method of varying applicable thermal conditions involves heating the molten steel surface in the mold, such as by arc heating or the like. One method uses induction-heating by the use of a flat-type coil as disclosed in Japanese Patent Laid-Open No. 56-68565, in which heat input into the meniscus can be controlled independently of the casting conditions. The flat-type coil is placed just above the molten steel surface in the mold so as to apply alternating current, thereby uniformly heating the surface of the molten steel. Since a high frequency current is caused to flow into the heating coil, Joule heat is generated on the conductor, and is likely to damage the coil. Accordingly, cooling water is caused to flow into the coil in order to prevent such damage. However, the presence of a flat-type coil arranged just above the molten steel surface presents serious problems.

(1) In order to obtain good heat efficiency, it is necessary to position the heating coil close to the molten steel surface. However, this raises the level of the molten steel surface and immerse the heating coil in the molten steel, thus damaging the coil and further causing the leakage of cooling water, which contacts the molten steel, resulting in a steam explosion.

(2) In general, a swirl-type level sensor for measuring the level of the molten steel is usually provided just above the molten steel surface. Such a sensor is vulnerable to heating by the heating coil with resulting damage.

(3) The heating coil must be detached from time to time for the exchange of an immersion nozzle and tundish in order to avoid damage of the coil.

(4) Mold powder is normally introduced into the molten steel to enhance the temperature maintenance on the molten steel surface, the absorption of non-metallic inclusions, the lubrication between the mold and the cast products, and the like. The mold powder is continuously supplied from the top in order to ensure the provision of a predetermined volume or more. Since the induction heating coil is thereby subjected to adverse conditions, maintenance control is difficult.

SUMMARY OF THE INVENTION

Accordingly, it is an object of the present invention to overcome the foregoing disadvantages, and this is achieved by providing an apparatus and method for continuous casting of steel in which the surface of the molten steel in a continuous casting mold is efficiently heated by using an induction heating coil arranged outside of the mold.

As a result of thoroughly examining the complicated relationships existing between the mold materials, its thickness, the characteristics of an induction coil and the nature of the molten steel in the mold, the present invention has been achieved by creating an apparatus and method for continuous casting steel as hereinafter described.

The present invention provides a novel apparatus for continuous casting steel comprising a substantially vertical continuous-casting mold having a pair of long side frames and a pair of short side frames; wherein the pair of long side frames and the pair of short side frames are formed of a metal having low electrical conductivity; an immersion nozzle arranged to supply molten steel to the mold; and an induction heating coil surrounded by a backup frame and surrounding the continuous-casting mold, the induction heating coil being arranged for induction-heating the surface of the molten steel and neighboring portions thereof; wherein substantially the following conditions are met:

$$\xi^2=\sigma_1/\sigma_2\leqq 4$$

$$1/10\leqq\eta=(2\mu_0\cdot\sigma_2\cdot\omega)^{0.5}\cdot d\leqq 10$$

where $\xi$ designates the ratio of electrical conductivity of the mold and the molten steel $\sigma_1$ designates the electrical conductivity of the mold $\sigma_2$ designates the electrical conductivity of the molten steel $\mu_0$ designates the permeability in a vacuum d designates the thickness $\omega$ designates the pulsatance of the electromagnetic wave $\eta$ designates the ratio of the penetration depth of the magnetic field the molten steel to the mold thickness.

The foregoing and other objects of the present invention will be apparent in the following detailed description, and in the drawings, which are intended to be illustrative but not to limit the scope of the invention, which is defined in the appended claims.

DESCRIPTION OF THE PREFERRED EMBODIMENTS

It will be appreciated that, when AC current flows into a coil, an electromagnetic wave is generated and propagates through space. The electric field strength $B_0$ of the wave increases in proportion to the current $I_0$ flowing in the coil and this relationship may be expressed by the formula (1).

$$B_0=\alpha\mu_0 I_0 \tag{1}$$

where $\alpha$ is a constant determined by the configuration of the coil, and $\mu_0$ is permeability in vacuum and has the value of $4\pi\times10^{-7}$H/m.

Figure 1:
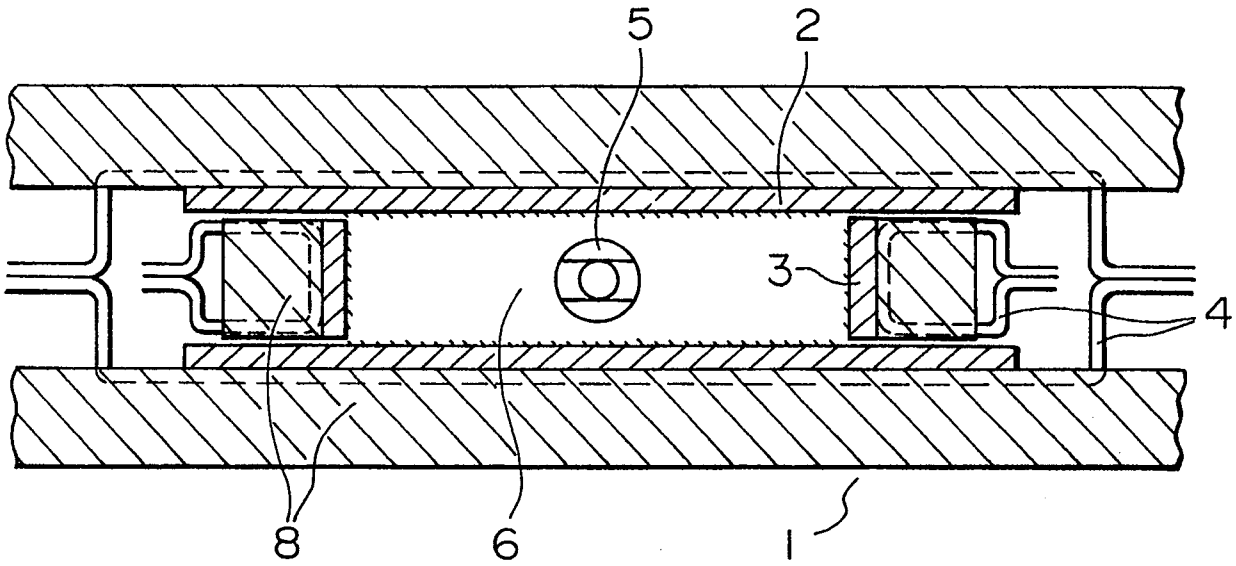
FIG. 1 is a schematic top view showing one form of mold used for continuous casting according to the present invention.
Figure 2:
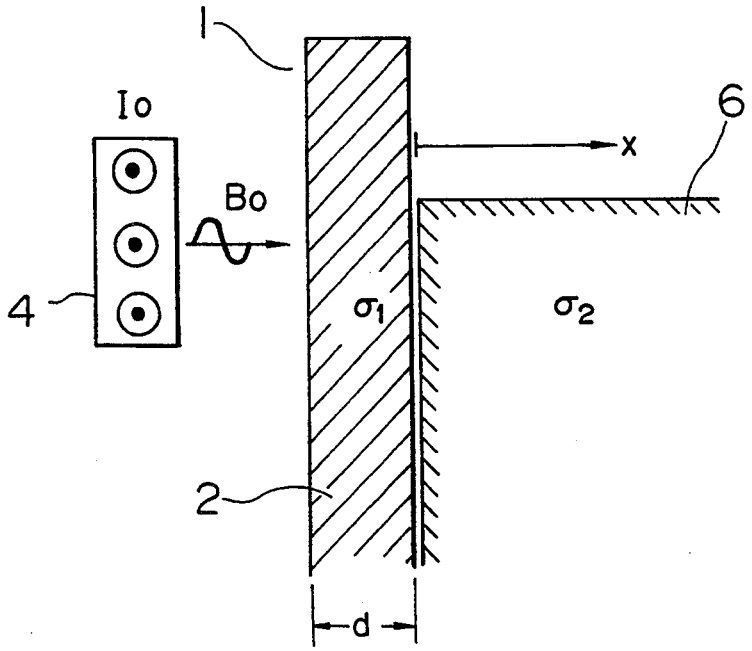
FIG. 2 is a partial sectional view showing the mold when continuous casting is performed.

Referring to FIGS. 1 and 2 of the drawings, in order to heat molten steel 6 in a mold 1 from an induction heating coil 4 arranged outside of the mold 1, the electromagnetic wave generated by the coil impinges upon the molten steel 6 having an electrical conductivity $\sigma_2$ through the mold 1, which has a thickness d, and has an electrical conductivity $\sigma_1$.

Figure 3:
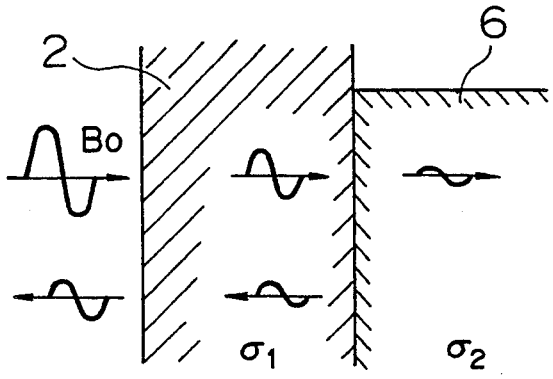
FIG. 3 is a schematic view relating to induction heating.

As is illustrated in FIG. 3, the electromagnetic wave $B_0$ which impinges upon the molten steel 6 is partially reflected on the surface of the mold 1 and on the surface which contacts the mold 1 and the molten steel 6, and is also partially absorbed in the mold 1, thus weakening the electromagnetic wave which reaches the molten steel 6. When the electromagnetic wave reaches the molten steel 6, it generates induction electricity and supplies Joule heat to the molten steel 6.

It is verified that when the Joule heat is $\bar{q}$ (as a matter of convenience, the left side of the formula (2) is so expressed), the Joule heat $\bar{q}$ can be expressed by the following formulas (2)–(5) on the basis of the theory of electromagnetic wave propagation in the metal:

$$q=(2/\mu_0)B_0^2\omega\times g(\xi,\eta)\exp\{-(2)^{0.5}kx\} \tag{2}$$

$$g(\xi,\eta)=4/\{(\xi+1)^2\exp(\xi\eta)+(\xi-1)^2\exp(-\xi\eta)+2(1-\xi^2)\cos\xi\eta\} \tag{3}$$

$$\xi=(\sigma_1/\sigma_2)^{0.5},\ \eta=(2)^{0.5}kd \tag{4}$$

$$k=(\mu_0\sigma_2\omega)^{0.5} \tag{5}$$

where x is the distance from the point of contact between the mold 1 and the molten steel 6 and $\omega$ is the pulsatance of the electromagnetic wave. The relationship between pulsatance $\omega$ and the frequency f is expressed by the following formula (6).

$$\omega=2\pi f \tag{6}$$

As is seen from the formulas (2)–(6), the generated heat value $\bar{q}$ is dependent in a complicated manner upon the thickness d of the mold, its electrical conductivity $\sigma_1$ and the pulsatance $\omega$ of the electromagnetic wave. The dependency is represented by the characteristic function g ($\xi$, $\eta$).

Figure 4:
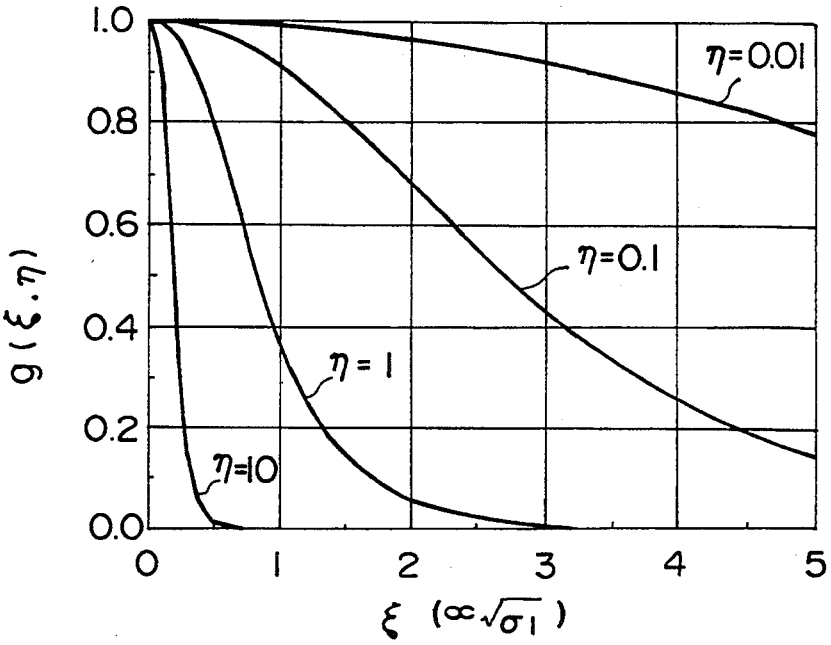
FIG. 4 is a diagram indicating the characteristics of certain relationships between the ratio of electrical conductivity of the mold and the molten steel, on the one hand, and the ratio of penetration depth of the magnetic field to the mold thickness, on the other.

FIG. 4 is a diagram representing g ($\xi$, $\eta$) regarded as the function of $\xi$ in the cases where $\eta$ is 0.01, 0.1, 1 and 10, respectively. On the other hand, FIG. 5 is a diagram representing g ($\xi$, $\eta$) regarded as the function of $\eta$ in the cases where $\xi$ is 0.1, 0.5, 1 and 2, respectively.

Figure 5:
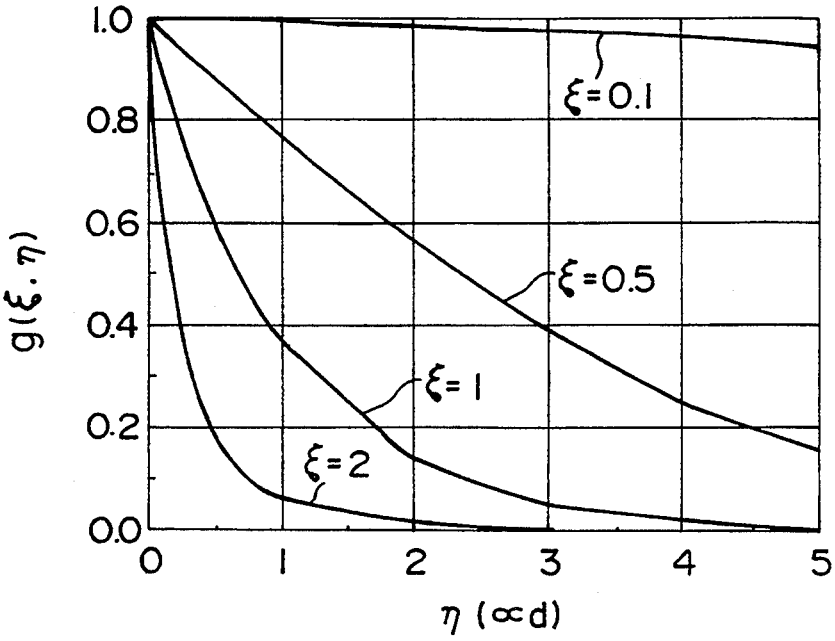
FIG. 5 is another diagram indicating improvement of heat efficiency in accordance with this invention by reducing electrical conductivity and decreasing the thickness of the mold.

As is shown in FIGS. 4 and 5, as $\xi$ and $\eta$ increase, g ($\xi$, $\eta$) decreases. Thus, improvement of heat efficiency can be achieved by reducing the electrical conductivity $\sigma_1$ and decreasing the thickness d of the mold.

The dependency of the heat value $\bar{q}$ on the pulsatance $\omega$ is represented by $\eta^2$ g ($\xi$, $\eta$) with respect to $\eta$. For example, when $\xi$ is 1, the dependency of the heat value $\bar{q}$ is indicated in the diagram shown in FIG. 6. As is seen from FIG. 6, when $\eta$ is a certain specific value $\eta_0$, the heat value becomes maximum, and thus, the optimal pulsatance $\omega$ is present in the heat value $\bar{q}$.

As a result it is preferable to determine the electrical conductivity $\sigma_1$ of the mold 1, its thickness d and the pulsatance $\omega$ of the current flowing in the induction heating coil so as to substantially satisfy the following formulas (7) and (8).

$$\xi^2=\sigma_1/\sigma_2\leqq 4 \quad (7)$$

$$1/10\leqq\eta=(2\mu_0\sigma_2\omega)^{0.5}\cdot d\leqq 10 \quad (8)$$

Also, since the mold must be formed of a material having a lower electrical conductivity than copper and good heat resistance, a metal having low electrical conductivity is best suited for the material of the mold 1.

Figure 6:
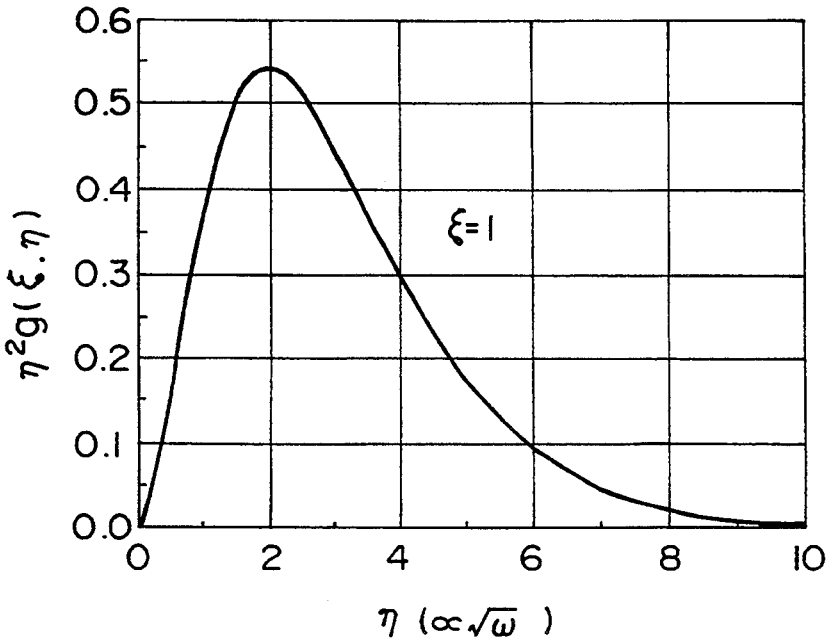
FIG. 6 is a diagram representing a relationship between heat value and pulsatance.
Figure 7:
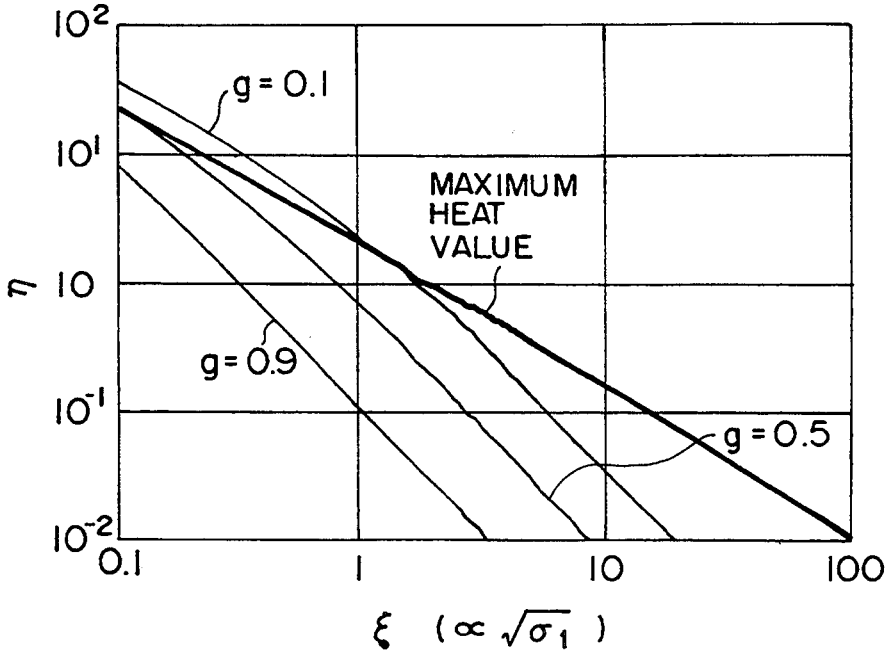
FIG. 7 is a diagram illustrating relationships of the values of formulas utilized in the practice of this invention.

Restrictions of values applicable to the above formula (7) will now be described. FIG. 7 is a diagram indicating $\eta_0$ to achieve the maximum heat value and $\eta$ regarded as the function of $\xi$ in the cases where the heat efficiency g ($\xi$, $\eta$) is 0.1, 0.5 and 0.9, respectively, as represented in FIG. 6. As is seen from FIG. 7, when $\xi\geqq 2$ and $\eta$ is determined so as to obtain the maximum heat value, the heat efficiency is about 10% or less. Also, as $\xi$ increases, the heat efficiency sharply drops inversely proportional to $\xi^2$. Therefore, it is important that $\xi$ is substantially equal to or less than 2, that is, $\xi^2\leqq 4$ when both factors such as heat value and heat efficiency are taken into consideration.

It is not particularly necessary in accordance with this invention to determine the lower limit of $\xi$. However, it may be determined as $\xi^2\geqq(10^5\ \Omega^{-1}\ m^{-1}/10^8\ \Omega^{-1}\ 'm^{-1})=10^{-3}$ ($\xi\geqq 3\times 10^{-2}$) if it is clarified that the molten steel is cast in a metal mold the electrical conductivity of which is in a range of between about $10^5\ \Omega^{-1}\ m^{-1}$ and $10^8\ \Omega^{-1}\ m^{-1}$.

Figure 8:
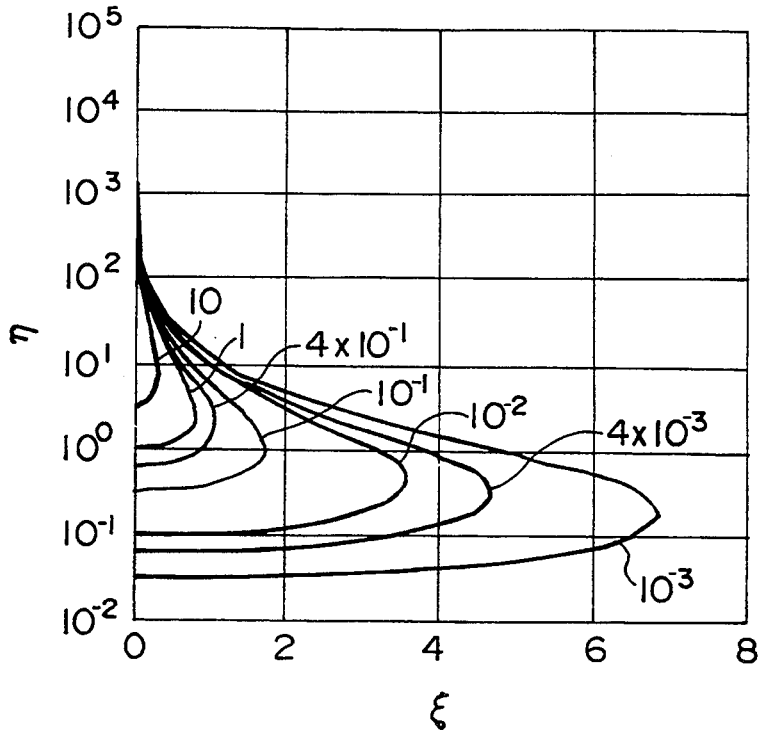
FIG. 8 is a diagram indicating relationships between $\xi$ and $\eta$ to obtain substantially constant heat efficiency according to this invention.

The restrictions of the values of the above formula (8) will now be described. FIG. 8 indicates $\xi$ and $\eta$ when the heat value, that is, $\eta^2$ g($\xi$, $\eta$), is constant. As is clearly seen from FIG. 8, when $\eta<(1/10)$, $\eta^2$ g($\xi$, $\eta$)$<10^{-2}$, thus decreasing the heat value. On the other hand, in the case where $\eta>10$, although $\eta^2$ g($\xi$, $\eta$) is greater when $\xi$ is smaller, only a small increase of $\xi$ drops $\eta^2$ g($\xi$, $\eta$) sharply, thus decreasing the heat value. That is, the heat value in the case where $\eta>10$ is strongly affected by $\xi$. Hence, it is preferable that $(1/10)\leqq\eta\leqq 10$ when both factors are taken into consideration such as to sufficiently obtain the heat value and not to vary it considerably with respect to $\xi$ (to be hardly affected by $\xi$).

As derived above, according to the present invention, since the material of the mold and the thickness thereof are suitably determined and a metal having low electrical conductivity is used as the mold material, it has been discovered that it is possible to supply heat energy efficiently to the surface of the molten steel by using an induction heating coil arranged outside of the mold.

Important considerations further apply to the thickness of the mold.

Conventionally, efficiency of induction heating by an AC magnetic field is evaluated according to the position of penetration of the electromagnetic wave having a frequency f when a mold having a thickness of d and an electrical conductivity of $\sigma_1$ is placed in a vacuum (or in air).

Figure 10:
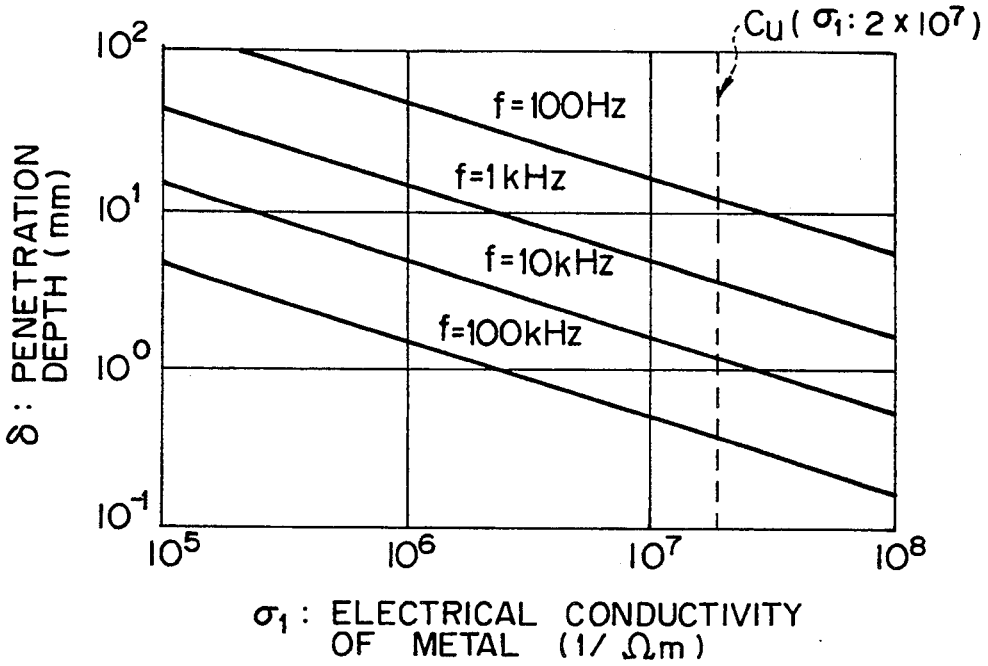
FIG. 10 PRIOR ART
FIG. 10 is a diagram indicating prior art relationships in a conventional mold.

According to one of the guidelines, when the relationship between the penetration depth $\delta$ and the mold thickness d is about $d\leqq\delta$, it is believed that the electromagnetic wave effectively permeates. The relationship between f, d and $\sigma_1$ based on this permeation is shown in FIG. 10.

For example, when the mold is formed of copper ($\sigma_1=2\times 10^7\ \Omega^{-1}\ m^{-1}$), the penetration depth $\delta$ is approximately 4 mm, and 1.1 mm, when the electromagnetic wave has a frequency at 1 kHz and 10 kHz, respectively. Thus, the thickness of the mold must be approximately equivalent or less than the respective values of penetration depth.

The heat efficiency when evaluated by the above process takes only permeability of the electromagnetic wave into consideration. In fact, however, since the molten steel, which is also conductive, is present in the mold, it is necessary to consider the damping of the electromagnetic wave in the molten steel.

Heating the molten steel is targeted rather than permeability of the electromagnetic wave, and consequently, the heat value in the molten steel will now be discussed.

Figure 9:
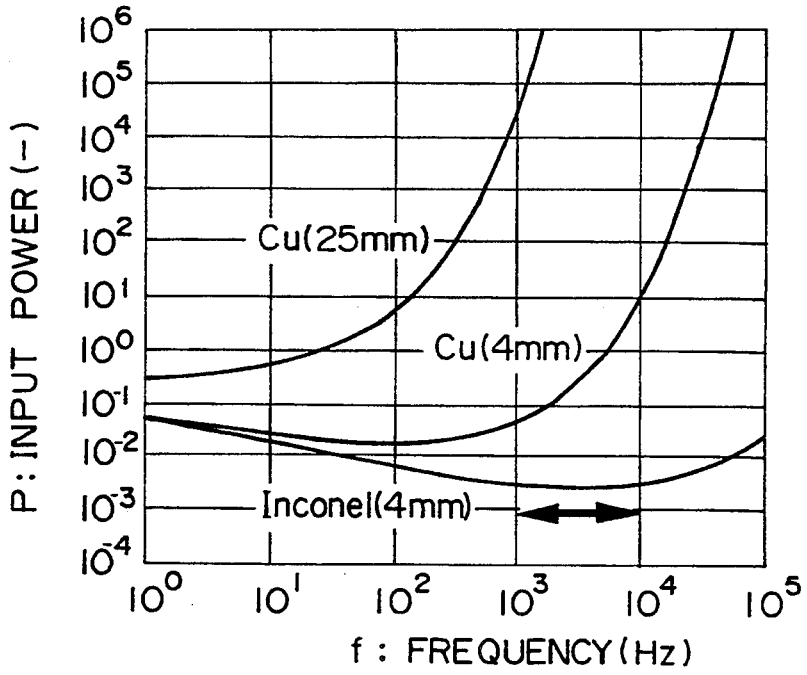
FIG. 9 is a diagram exponentially representing relationships between the input power and frequency.

FIG. 9 is a diagram exponentially indicating the relationship between the power P required for obtaining the constant heat value $\bar{q}$ found by the foregoing formula (2) and the frequency f.

Two kinds of materials Cu and Inconel 718 in the embodiment are used as the mold material. The diagram indicates molds having thicknesses of 4 mm and 25 mm, respectively.

Cu having a thickness of 4 mm remarkably reduces power to a lower level than Cu having a thickness of 25 mm, as will be seen in FIG. 9. An electrically low-conductive material such as Inconel 718 further reduces power and takes the value down one level or more.

Also, as indicated by the arrow in FIG. 9, according to the present invention, considering a factor such as heating, it is determined that the optimal frequency is required to obtain good heat efficiency, which idea was not even conceived according to the conventional process, only taking permeability of electromagnetic wave into consideration.

As is shown in FIG. 9, the range of the optimal frequency is preferably between about 1–10 kHz.

In order to prevent a backup frame from being thermally damaged by a induction heating coil arranged in the backup frame, a coil-arranging portion may be partially formed on non-magnetic stainless steel. The thickness D of the non-magnetic stainless steel is preferably approximately according to the following formula:

$$D\geqq 1/\sqrt{\pi\mu\sigma f}$$

where $\mu$ designates permeability of the non-magnetic stainless steel $$(\approx 4\pi\times 10^{-7}\mathrm{H/m})$$

Figure 11:
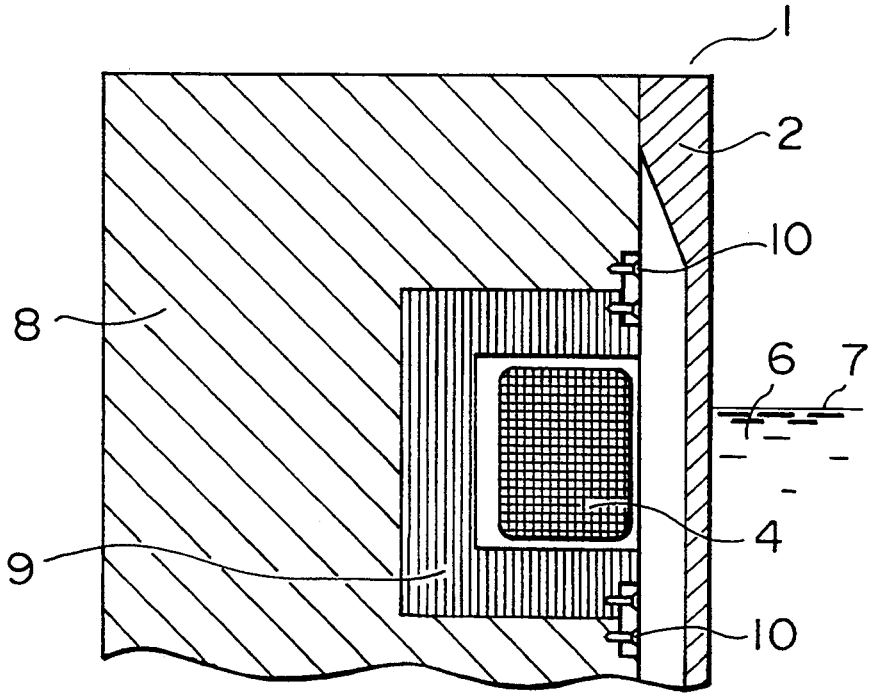
FIG. 11 is a sectional side view showing one embodiment of a mold having a built-in induction heating coil according to the present invention.

$\sigma$ designates electrical conductivity of the non-magnetic stainless steel f designates high frequency FIG. 11 is a side sectional view of an embodiment of the present invention.

According to the present invention, as illustrated in FIG. 11, an induction heating coil 4 is integrated via vises 10 into the level of a meniscus 7 within a backup frame 8 supporting a mold 1. This enables resolution of problems such as damage of the coil caused by heating the molten steel 6 from just above the mold due to the conventional process, the danger of steam explosion, coil-detachment work for the exchange of an immersion nozzle 5 (FIG. 1) or a tundish, pollution due to mold powder, and the like.

On the other hand, if high frequency heating is performed on the rear surface of the mold, the electromagnetic wave is absorbed in the mold, and it is consequently necessary to increase the power wastefully in order to supply the required heat to the surface of the molten steel.

The permeability $\eta_t$ of the electromagnetic wave can be expressed by the following formula.

$$\eta_t = \exp(-\sqrt{\pi\mu\sigma f} \cdot d) \tag{9}$$

where $\sigma$ is the electrical conductivity of the mold, $\mu$ designates permeability, d is the thickness, and f is the frequency of the electromagnetic wave. Thus, a mold material preferably has a smaller electrical conductivity $\sigma$ and a higher hot strength with a view to decreasing the thickness d. For example, a Ni—Cr—Fe alloy or a Ni—Cr—Co alloy may be used.

Induction heat also travels to the backup frame 8 including the coil 4. In general, carbon steel is selected as the material of the backup frame 8. The carbon steel has a lower electrical conductivity of approximately $10^7\ \Omega^{-1}\ m^{-1}$ but a considerably higher relative permeability (the ratio of magnetic permeability in a material to that in a vacuum) of approximately 7000. Thus, the surface of the backup frame 8 contacting the induction heating coil 4 is heated to the melting point. In order to overcome this drawback, the surface of the backup frame 8 contacting the induction heating coil 4 is surrounded by a non-magnetic material 9 having a relative permeability of approximately 1 so as to allow the electromagnetic wave to be damped gradually therein, thus preventing damage of the backup frame 8 by heating. For example, a non-magnetic stainless steel 9 (SUS304, or the like) is used as the non-magnetic material. The thickness D is preferably approximately as follows:

$$D \geqq 1/\sqrt{\pi\mu\sigma f} \tag{10}$$

where $\mu$ and $\sigma$ represent the permeability and electrical conductivity of the non-magnetic stainless steel, respectively.

Also, in order to efficiently heat the molten steel in the mold, a ferromagnetic wall member is arranged to surround the top, bottom and rear surfaces of the coil, except for the surface contacting the mold, thereby increasing the strength of the high-frequency magnetic field travelling to the surface of the molten steel. The ferromagnetic wall member may be obtained by a process wherein thin silicon steel plates are insulated and laminated so as to obtain a multi-laminated member.

Figure 12:
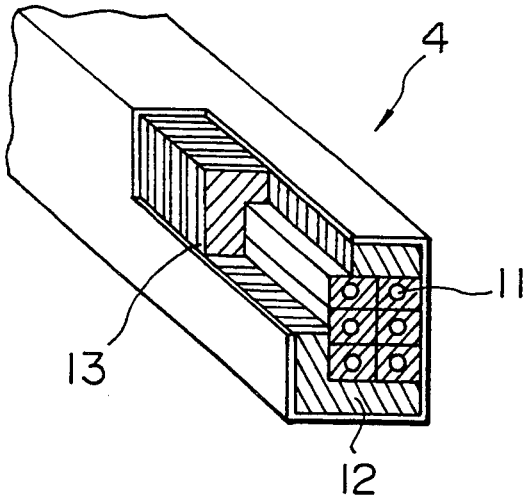
FIG. 12 is a partially sectional perspective view showing a construction of an induction heating coil according to the present invention.

As shown in FIG. 12, one form of induction heating coil according to this invention is constructed as follows. Hollow copper pipes 11 are insulated from each other by an insulating material 13 and more than one pipe is bound. Cooling water flows through the pipes 11. The top, bottom and rear surfaces of the pipes 11, except for the surface contacting the molten steel, are also surrounded by a U-shaped ferromagnetic wall member 12, thereby concentrating the generated electromagnetic field on the surface adjacent to the molten steel. As described above, the ferromagnetic material may include a silicon steel plate. However, the coil surrounded by only the silicon steel plate also generates induction current on the silicon steel plates due to high frequency, thereby generating Joule heat and lowering efficiency. Hence, the silicon steel plates are as thin as possible. Then, they are insulated from each other by the insulating material 13 and laminated, thereby essentially preventing induction current from flowing into the silicon steel plates.

The present invention will now be described in further detail with reference to FIG. 1 which is a schematic front view showing a mold used for continuous casting applicable to one embodiment of the present invention.

The induction heating coil 4 is arranged around a mold 1, thereby induction-heating the molten steel 6 within the mold 1. The mold 1 also includes an immersion nozzle 5. The construction as viewed from the side is substantially the same as that of FIG. 2.

The molds of the continuously-casting apparatus used for this embodiment had a width of 1200 mm and a thickness of 260 mm. The casting through-put volume was 4.0 ton/min. Four kinds of mold materials of the present invention, M1, M3, M4, M5 and a conventional mold material M2 each having a composition and electrical conductivity shown in Table 1 were used as the molds. The properties were as set forth in Table 1.

TABLE 1

| Mold Material<br>Name of Material | M1<br>Inconel<br>718 | M2<br>Cu (CCM-A)<br>Conventional Mold | M3<br>RENE41 | M4<br>UDIMET700 | M5<br>Waspaloy |
|---|---|---|---|---|---|
| Chemical Composition (wt %) | | | | | |
| Ni | 52 | | 55.3 | 53.4 | 58.3 |
| Cu | — | ≧98.0 | — | — | — |
| Cr | 19 | 0.5–1.5 | 19 | 12 | 19.5 |
| Co | — | | 11 | 18.5 | 13.5 |
| Mo | 3 | | 10 | 5.2 | 4.3 |
| Fe | 19 | | — | — | — |
| C | <0.1 | | 0.09 | 0.08 | 0.08 |
| Mn | <0.5 | | — | — | — |
| Si | <0.75 | | — | — | — |
| Al | 0.5 | | 1.5 | 4.3 | 1.3 |
| Ti | 0.9 | | 3.1 | 3.5 | 3.0 |

TABLE 1-continued

| Mold Material<br>Name of Material | M1<br>Inconel<br>718 | M2<br>Cu (CCM-A)<br>Conventional Mold | M3<br>RENE41 | M4<br>UDIMET700 | M5<br>Waspaloy |
|---|---|---|---|---|---|
| Nb + Ta | 5.1 | | — | — | — |
| B | — | | 0.005 | 0.03 | 0.006 |
| Zr | — | 0.08–0.30 | — | — | 0.06 |
| Electrical Conductivity ($\Omega^{-1}m^{-1}$) | $9 \times 10^5$ | $6 \times 10^7$ | $8 \times 10^5$ | $8 \times 10^5$ | $8 \times 10^5$ |

The electrical conductivity $\sigma_2$ of the molten steel was $7\times10^5\ \Omega^{-1}\ m^{-1}$. The electrical conductivity $\sigma_1$ of the respective mold materials was M1: $9\times10^5\ \Omega^{-1}\ m^{-1}$, M3, M4 and M5: $8\times10^5\ \Omega^{-1}\ m^{-1}$, and the conventional mold material M2: $6\times10^7\ \Omega^{-1}\ m^{-1}$. Thus, the value $\xi$ of the mold materials M1–M5 obtained by the foregoing formula (4) was M1, M3, M4 and M5: 1.1 and M2: 9.3.

The other conditions used in carrying out this embodiment of the invention are shown in Table 2. As is seen from Table 2, the frequency of the current flowing into the induction heating coil was 8 kHz for Embodiments 1–7, except for the conventional process 4. The frequency 8 kHz for the molds formed of the material M1, M3, M4 and M5 conformed with the frequency such as to obtain the maximum efficiency shown in FIG. 6 when the thickness of the mold was equal to that of the mold in Embodiment No. 1. The results of calculations using the formulas (7) and (8) are also shown in Table 2.

TABLE 2

| Embodiment No. | Mold Material | Thickness of Mold (mm) | Frequency (kHz) | $\epsilon$ | $\eta$ |
|---|---|---|---|---|---|
| 1 (Present invention 1) | M1 | 6 | 8 | 1.1 | 1.8 |
| 2 (Present invention 2) | M1 | 25 | 8 | 1.1 | 7.4 |
| 3 (Comparative Example) | M2 | 25 | 8 | 9.3 | 7.4 |
| 4 (Conventional Process) | M2 | 25 | — | 9.3 | — |
| 5 (Present invention 3) | M3 | 6 | 8 | 1.1 | 1.8 |
| 6 (Present invention 4) | M4 | 6 | 8 | 1.1 | 1.8 |
| 7 (Present invention 5) | M5 | 6 | 8 | 1.1 | 1.8 |

Figure 13:
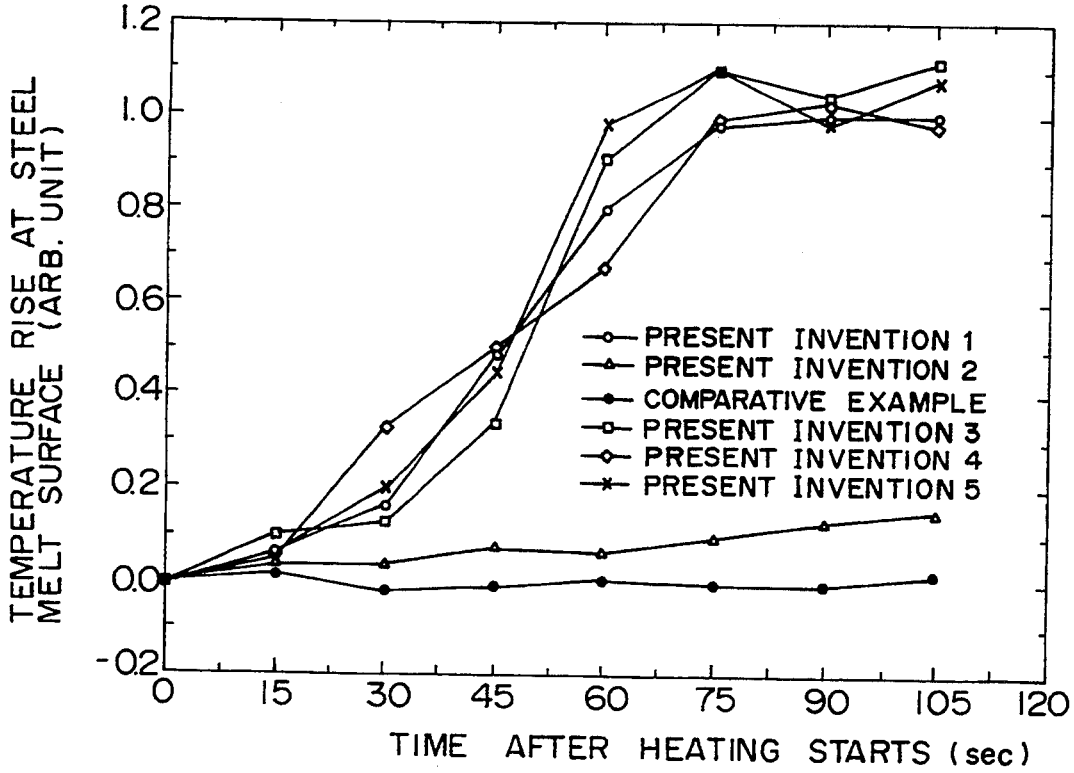
FIG. 13 is a temperature-time diagram of actual runs, showing the advantages of the present invention.

FIG. 13 indicates the results of measuring the change in the temperature at the surface of the molten steel in the embodiments Nos. 1–7, except for the conventional mold 4, after coil induction heating starts.

As is clearly understood from FIG. 13, the molten steel can be heated when molds formed of the low electrical-conductive materials M1, M3, M4 and M5 are used, whereas the molten steel can hardly be heated when a mold formed of the high electrical-conductive material M2 is used. Also, when the thickness of the mold is greater, the heat efficiency becomes lower (See the present invention 2).

Figure 14:
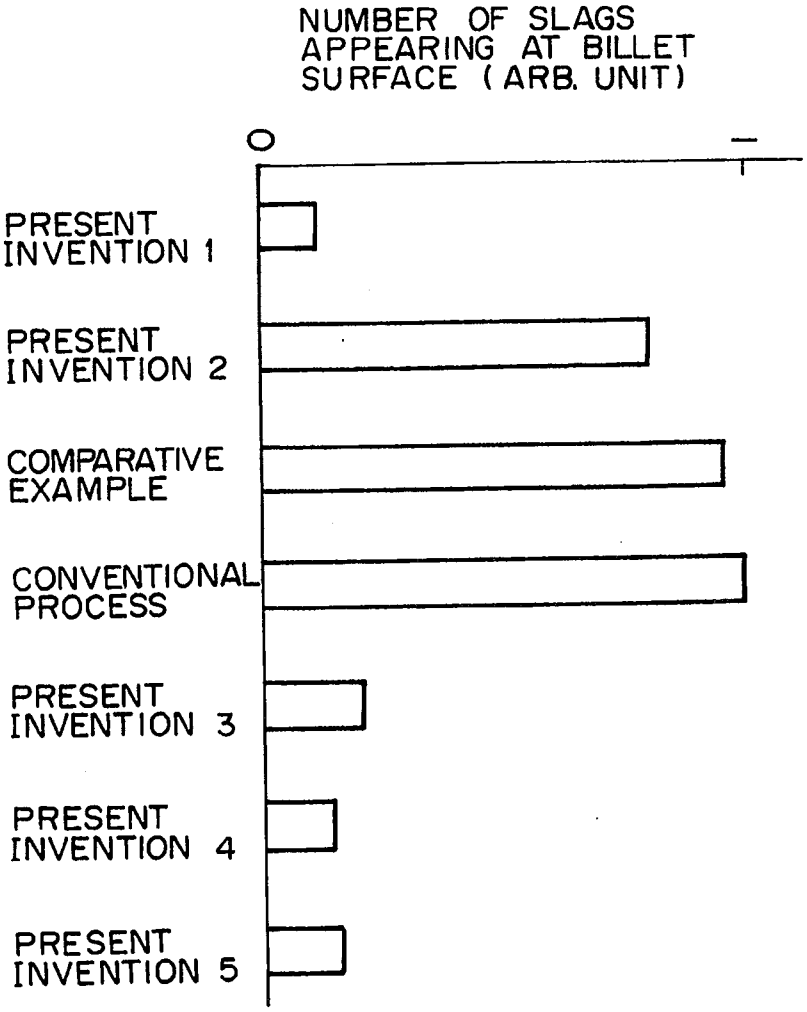
FIGS. 14 and 15 are graphs showing the results of actual runs, and showing further advantages of the present invention.
Figure 15:
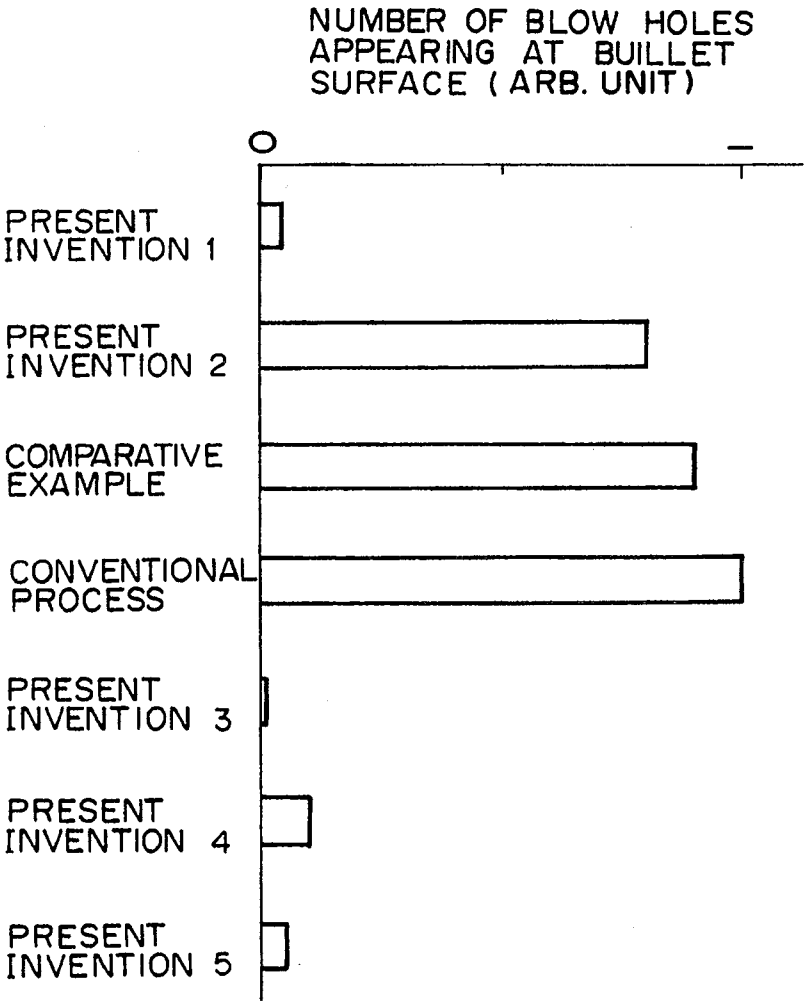

FIGS. 14 and 15 show the results of examining the number of slag patches and blow holes in arbitrary units, respectively, appearing at the surface of the cast products which is produced according to each of the embodiments Nos. 1–7.

The slag patches are caused by mold powder appearing at the surface of the cast products, which mold powder is introduced into the molten steel with a view to enhancing the temperature maintenance and anti-oxidation on the molten steel surface of the mold of the continuous casting apparatus and lubrication between the mold and the cast products. The blow holes are caused by bubbles appearing at the surface of the cast products, which bubbles are formed of Ar or the like and blow into the immersion nozzle so as to prevent the immersion nozzle from clogging.

As is apparent from the above results, when molds having a low electrical conductivity and a smaller thickness are used as shown in Embodiment No. 1 (the present invention 1), Embodiment No. 5 (the present invention 3), Embodiment 6 (the present invention 4) and Embodiment No. 7 (the present invention 5), the surface of the molten steel can be particularly efficiently heated, thus remarkably improving the surface characteristics of the cast products.

As will be clearly understood from the foregoing description, the present invention offers important advantages.

In an apparatus for induction-heating the surface of the molten steel in a continuously-casting mold by using an induction heating coil, a mold material and the thickness thereof are determined suitably and a metal having low electrical conductivity is used for the material, thereby efficiently supplying heat energy to the molten steel surface by using a thermal coil arranged outside of the mold. As a result, cast products having good surface characteristics can be reliably produced. Use of a backup frame is advantageous and it can also be prevented from thermally melting. Further, the danger caused by induction-heating from just above the mold is eliminated and problems in terms of maintenance and control are readily overcome in accordance with this invention.

What is claimed is:

1. An apparatus for continuous casting of steel comprising:

a substantially vertical continuous-casting mold having a pair of long side frames and a pair of short side frames, said long side frames and said short side frames being formed of a metal having low electrical conductivity;

an immersion nozzle arranged for supplying molten steel to said mold; and an induction heating coil surrounded by a backup frame and surrounding said continuous-casting mold, said induction heating coil induction-heating the surface of said molten steel and neighboring portions thereof;

wherein said mold and said steel meet the following conditions:

$$\xi^2=\sigma_1/\sigma_2\leqq 4$$

$$1/10\leqq\eta=(2\mu_0\cdot\sigma_2\cdot\omega)^{0.5}\cdot d\leqq 10$$

where $\xi$ designates the ratio of electrical conductivity of the mold and the molten steel $\sigma_1$ designates the electrical conductivity of said mold $\sigma_2$ designates the electrical conductivity of said molten steel $\mu_0$ designates the permeability in a vacuum d designates the thickness of said mold $\omega$ designates the pulsatance of electromagnetic wave $\eta$ designates the ratio of the penetration depth of the magnetic field to said molten steel to mold thickness.

2. An apparatus for continuous casting of steel according to claim 1, wherein a frequency of power applied to said induction heating coil is in the range of about 1–10 kHz.

3. An apparatus for continuous casting of steel according to claim 1, wherein said backup frame around said mold is formed of non-magnetic stainless steel at only a portion contacting said induction heating coil of said backup frame.

4. An apparatus for continuous casting steel according to claim 3, wherein the thickness D of said portion of said non-magnetic stainless steel is expressed by the following relationship:

$$D \geqq 1/\sqrt{\pi\mu\sigma f}$$

where $\mu$ designates the permeability of said non-magnetic stainless steel $\sigma$ designates the electrical conductivity of said non-magnetic stainless steel, and f designates high frequency.

5. An apparatus for continuous casting steel according to any one of claims 1 and 3, wherein a ferromagnetic wall member is arranged to surround three (the top, bottom and rear) surfaces of said induction heating coil arranged within said backup frame surrounding said mold, except for the surface contacting said mold.

6. An apparatus for continuous casting of steel according to claim 5, wherein said ferromagnetic wall member is a multi-laminated member formed of a thin silicon steel plate and an insulating material.

7. In a method for continuous casting of steel in a substantially vertical continuous-casting mold having a plurality of frames formed of a metal having low electrical conductivity, the steps which comprise:

(a) arranging an immersion nozzle for supplying molten steel to said mold;

(b) supplying heat to the surface of said molten steel from an externally arranged induction heating coil substantially surrounding said continuous-casting mold; and (c) controlling said induction heating of the surface of said molten steel and neighboring portions thereof with a controlled electromagnetic wave while controlling the penetration depth of its magnetic field into said molten steel under substantially the following conditions:

$$\xi^2 = \sigma_1/\sigma_2 \leqq 4$$

$$1/10 \leqq \eta = (2\mu_0 \cdot \sigma_2 \cdot \omega)^{0.5} \cdot d \leqq 10$$

where $\xi$ designates the ratio of electrical conductivity of the mold and the molten steel $\sigma_1$ designates the electrical conductivity of said mold $\sigma_2$ designates the electrical conductivity of said molten steel $\mu_0$ designates the permeability in a vacuum d designates the thickness of said mold $\omega$ designates the pulsatance of electromagnetic wave, and $\eta$ designates the ratio of the penetration depth of the magnetic field to said molten steel to mold thickness.

* * * * *